US012152574B2

(12) United States Patent
Veprik

(10) Patent No.: US 12,152,574 B2
(45) Date of Patent: Nov. 26, 2024

(54) COMPRESSOR UNIT OF A SPLIT STIRLING CRYOGENIC REFRIGERATION DEVICE

(71) Applicant: CRYO TECH LTD., Ein Harod (IL)

(72) Inventor: Alexander Veprik, Kiriyat Motzkin (IL)

(73) Assignee: CRYO TECH LTD., Ein Harod (IL)

( * ) Notice: Subject to any disclaimer, the term of this patent is extended or adjusted under 35 U.S.C. 154(b) by 376 days.

(21) Appl. No.: 17/374,996

(22) Filed: Jul. 14, 2021

(65) Prior Publication Data

US 2023/0017414 A1 Jan. 19, 2023

(51) Int. Cl.

| | |
|---|---|
| ***F25B 9/14*** | (2006.01) |
| ***F04B 35/04*** | (2006.01) |
| ***F04B 39/12*** | (2006.01) |
| ***F04B 53/14*** | (2006.01) |

(52) U.S. Cl.

CPC ..... *F04B 35/045* (2013.01); *F04B 39/126* (2013.01); *F04B 53/14* (2013.01); *F25B 9/14* (2013.01); *F25B 2309/001* (2013.01); *F25B 2400/073* (2013.01)

(58) Field of Classification Search

CPC ..... F25B 9/14; F25B 2309/001; F25B 2400/073; F04B 35/045; F04B 39/126; F04B 53/14

See application file for complete search history.

(56) References Cited

U.S. PATENT DOCUMENTS

| | | | | |
|---|---|---|---|---|
| 4,924,675 | A | 5/1990 | Higham et al. | |
| 5,231,337 | A * | 7/1993 | van Namen ..... | H02K 33/18 318/128 |
| 9,350,221 | B2 | 5/2016 | Al Otaibi | |

FOREIGN PATENT DOCUMENTS

| | | |
|---|---|---|
| EP | 0114069 | 7/1984 |

OTHER PUBLICATIONS

S.A. Evans, et al, "Permanent Magnet Linear Actuator for Static and Reciprocating Short-Stroke Electromechanical Systems" 2001, Full Document (Year: 2001).*

* cited by examiner

*Primary Examiner* — Nael N Babaa
(74) *Attorney, Agent, or Firm* — PEARL COHEN ZEDEK LATZER BARATZ LLP

(57) ABSTRACT

A compressor unit of a cryogenic refrigeration device includes a compression chamber that is connectable via a transfer line to an expander unit. A piston is configured to alternately compress and decompress a gaseous working agent in the compression chamber. An electromagnetic actuator includes a stator assembly with a driving coil that is wound about the longitudinal axis and that is enclosed within a toroidal back iron except for a coaxial cylindrical gap in a radially outward facing surface. A movable assembly connected to the piston includes two movable permanent magnets separated by a ferromagnetic spacer radially exterior to the stator assembly. The movable magnets are magnetized parallel to the longitudinal axis and opposite to one another such that an alternating electrical current in the driving coil causes the movable assembly to parallel to the longitudinal axis to periodically drive the piston into and out of the compression chamber.

11 Claims, 2 Drawing Sheets

COMPRESSOR UNIT OF A SPLIT STIRLING CRYOGENIC REFRIGERATION DEVICE

FIELD OF THE INVENTION

The present invention relates to cryogenic refrigeration devices. More particularly, the present invention relates to compressor unit of a split Stirling cryogenic refrigeration device.

BACKGROUND OF THE INVENTION

The second law of thermodynamics states that heat transfer occurs spontaneously only from hotter to colder bodies. However, the direction of heat flow may be reversed to cool an object to a colder temperature than its surroundings (or to heat an object to a warmer temperature than the surroundings) by applying external work. This principle is utilized by cooling devices such as heat pumps or refrigerators to absorb heat from a cooled location or object and to reject the heat to a warmer environment. A device that is designed to cool an object to cryogenic temperatures is sometimes referred to as a "cryocooler".

In some applications, a cryogenic cooling device may be used to cool an infrared detector, e.g., to achieve a required signal-to-noise ratio. A cooling device for such an application must often be sufficiently small so as to fit inside an of infrared imager or other electro-optical device into which the detector is incorporated. Similarly, power consumption by the cooling device must be sufficiently small so as to be compatible with the power source of the electro-optical device. Typically, such a cryocooler is based on the Stirling cycle, in which a gaseous working agent (e.g., helium, nitrogen, argon, or another suitable, typically inert gas) is cyclically compressed by a compression piston of a compressor unit and expanded within a cold finger of an expander unit while concurrently performing mechanical work to displace an expansion piston (displacer) that reciprocates inside the cold finger, A cold end of the cold finger that includes an expansion chamber is placed in thermal contact with the detector or other object that is to be cooled. Heat is removed from the cooled object during an expansion phase of the thermodynamic cycle. Typically, a pneumatically actuated expansion piston (displacer), containing a porous regenerative heat exchanger, is moved back and forth within the cold finger to transfer heat from the expansion chamber to a warm chamber at a base of the expander unit, typically at the opposite end of the expander unit from the expansion chamber. The transferred heat is rejected to the environment from the warm chamber.

In order to minimize the size of the expansion unit, as well as to reduce possibly disruptive vibrations, the gaseous working agent that effects the heat transfer and that drives the displacer is cyclically compressed and expanded by a piston in a compression chamber of a separate compression unit. The compression chamber is in direct pneumatic communication with the warm chamber of the expander unit via a flexible transfer line (e.g., a flexible tube) through which the gaseous working agent may flow back and forth. The expansion chamber of the expander unit is separated from the warm chamber by the spring-supported displacer, Typically, the piston within the compression unit is driven at a frequency that is approximately equal to the resonant frequency of the spring—supported displacer.

SUMMARY OF THE INVENTION

There is thus provided, in accordance with an embodiment of the invention, a compressor unit of a split Sterling cryogenic refrigeration device, the compressor unit including: a compression chamber that is connectable via a transfer line to an expander unit of the refrigeration device; a piston that is configured to be moved back and forth along a longitudinal axis to alternately compress and decompress a gaseous working agent in the compression chamber; and a linear electromagnetic actuator that is configured to drive the piston, the actuator including: a stator assembly that includes a driving coil that is wound about the longitudinal axis and that is enclosed within a toroidal back iron except for a coaxial cylindrical gap in a radially outward facing surface of the toroidal back iron; and a movable assembly that is connected to the piston, the movable assembly including two movable permanent magnets separated by a ferromagnetic spacer that are located radially exteriorly to the stator assembly, the two movable permanent magnets being magnetically polarized parallel to the longitudinal axis and oppositely to one another such that an alternating electrical current that flows through the driving coil causes the movable assembly to move back and forth parallel to the longitudinal axis so as to periodically drive the piston into and out of the compression chamber.

Furthermore, in accordance with an embodiment of the invention, the two movable permanent magnets include a ring magnet that is coaxial with the stator assembly.

Furthermore, in accordance with an embodiment of the invention, the compressor includes two stationary magnetic rings that are coaxial with and axially exterior to the two movable permanent magnets, the two stationary magnetic rings magnetized in opposite directions parallel to the longitudinal axis such that each stationary magnetic ring is magnetized opposite the nearer of the two movable permanent magnets.

Furthermore, in accordance with an embodiment of the invention, a front surface of the piston forms a proximal wall of the compression chamber.

Furthermore, in accordance with an embodiment of the invention, a columnar base of the piston is lined with a ferromagnetic material.

Furthermore, in accordance with an embodiment of the invention, the piston is configured to move axially within a bore of the stator assembly.

Furthermore, in accordance with an embodiment of the invention, the bore is lined with a ferromagnetic material.

Furthermore, in accordance with an embodiment of the invention, the movable assembly is mounted on a cylindrical wall of a cuplike structure that connects the movable assembly to the piston.

Furthermore, in accordance with an embodiment of the invention, a front surface of the piston is located at a distal end of a columnar base that extends from a floor of the cuplike structure.

There is further provided, in accordance with an embodiment of the invention, a cryogenic refrigeration device including: an expander unit including a capped cold finger tube that extends distally from a base, a cold end at a distal end of the capped cold finger tube configured to be placed in thermal contact with an object that is to be cooled, a moving assembly that includes a regenerative heat exchanger configured to move alternately toward the cold end and toward the base; a compressor unit including: a compression chamber; a piston that is configured to be moved back and forth along a longitudinal axis to alternately compress and decompress a gaseous working agent in the compression chamber; and a linear electromagnetic actuator that is configured to drive the piston, the actuator including a stator assembly that includes a driving coil that is wound about the longitudinal axis and that is enclosed within a toroidal back iron except for a coaxial cylindrical gap in a radially outward facing surface of the toroidal back iron, and a movable assembly that is connected to the piston, the movable assembly including two movable permanent magnets separated by a ferromagnetic spacer that are located radially exteriorly to the stator assembly, the two movable permanent magnets being magnetically polarized parallel to the longitudinal axis and oppositely to one another such that an alternating electrical current that flows through the driving coil causes the movable assembly to move back and forth parallel to the longitudinal axis so as to periodically drive the piston into and out of the compression chamber; and a transfer line that enables the gaseous working agent to flow between the compression chamber and the expander unit.

Furthermore, in accordance with an embodiment of the invention, the two movable permanent magnets include a ring magnet that is coaxial with the stator assembly.

Furthermore, in accordance with an embodiment of the invention, the device includes two stationary magnetic rings that are coaxial with and axially exterior to the two movable permanent magnets, the two stationary magnetic rings magnetized in opposite directions parallel to the longitudinal axis such that each stationary magnetic ring is magnetized opposite the nearer of the two movable permanent magnets.

Furthermore, in accordance with an embodiment of the invention, a front surface of the piston forms a proximal wall of the compression chamber.

Furthermore, in accordance with an embodiment of the invention, a columnar base of the piston is lined with a ferromagnetic material.

Furthermore, in accordance with an embodiment of the invention, e piston is configured to move axially within a bore of the stator assembly.

Furthermore, in accordance with an embodiment of the invention, the bore is lined with a ferromagnetic material.

Furthermore, in accordance with an embodiment of the invention, the movable assembly is mounted on a cylindrical wall of a cuplike structure that connects the movable assembly to the piston.

Furthermore, in accordance with an embodiment of the invention, a front surface of the piston is located at a distal end of a columnar base that extends from a floor of the cuplike structure.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
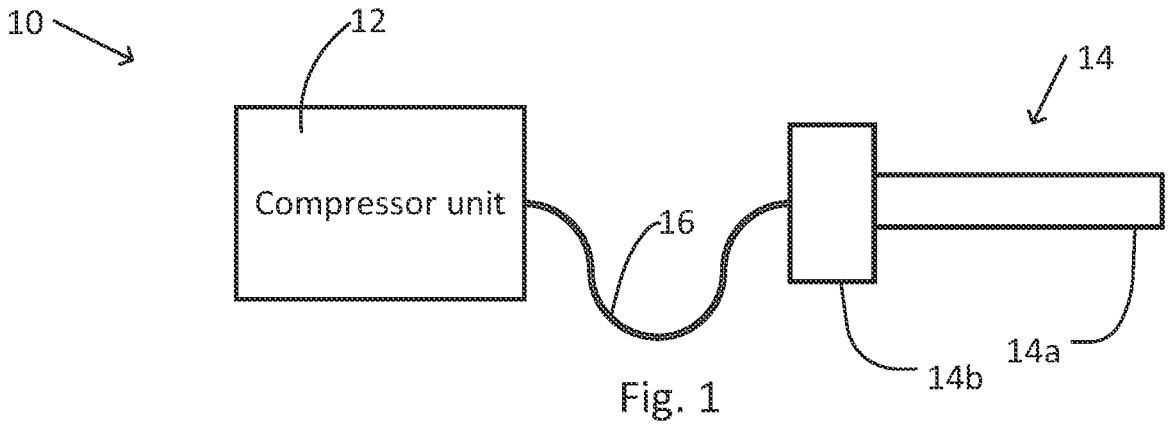
FIG. 1 schematically illustrates a split Stirling cryogenic refrigeration device with a compressor unit with an actuator with an interior stator, in accordance with an embodiment of the present invention.

In the following detailed description, numerous specific details are set tbrth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the invention, a split Stirling cryogenic refrigeration device (or cryocooler) includes a compressor unit and an expander unit that are connected by a configurable and flexible transfer line. A gaseous working agent (e.g., helium, nitrogen, argon, or another suitable, typically inert, gas) is alternately compressed and decompressed by a piston within the compression chamber of a compressor unit. The gaseous working agent also occupies regions of the expander. The regions filled by the gaseous working agent within the expander unit are connected to the gaseous working agent within the compression chamber of the compressor unit via the transfer line. The transfer line enables unobstructed flow of the gaseous working agent between the expander unit and the compressor unit. Furthermore, the transfer line may enable pneumatic transmission of changes in gas pressure within the compression chamber of the compressor unit to the expander unit. The transfer line typically includes a configurable and flexible sealed tube, thus enabling placement of the compressor unit at a location where the compressor unit, or vibrations that are generated by operation of the compressor unit, do not interfere with operation of the cryogenic refrigeration device, or of a device (e.g., infrared detector) that is cooled by the cryogenic refrigeration device.

The expander unit includes a capped cold finger tube that extends distally from a base that is pneumatically connected to the transfer line. The walls of the cold finger tube and of the base form a housing that is impermeable to the gaseous working agent. Thus, the gaseous working agent is completely enclosed and isolated from the ambient atmosphere by the housing of the expander unit, the transfer line, and the walk of the compressor unit. A distal (from the base) end of the cold finger tube is configured to be placed in thermal contact with an object to be cooled. The walls of the cold finger tube are designed, e.g., by selection of material and thickness of the walls, as to minimize parasitic conduction of heat from the hot cold finger base to the cold tip of the cold finger.

A moving assembly is enclosed within the cold finger tube. The moving assembly includes a displacer tube that is filled with a porous matrix, thus forming a regenerative heat exchanger. The moving assembly is configured to move alternately distally toward the distal cold end of the cold finger tube and proximally toward the base of the expander unit. This movement, which effects the removal of heat from the object being cooled and its rejection to the ambient atmosphere, is driven by changes in pressure and volume of the gaseous working agent that are caused by a cyclic reciprocation of a piston within the compression unit. Forces (e.g., due to changes in pressure on various surfaces, drag forces between the gaseous working agent and the porous matrix of the regenerative heat exchanger, or otherwise) that are created by reciprocation of the compression piston within the compression chamber of the compressor unit drive the motion of the moving assembly. The compression piston is driven directly by a compressor driver, e.g., a linear electromagnetic compressor driver.

The compressor unit includes a compressor driver with an electromagnetic driving mechanism that drives a compressor piston back and forth. For example, a distal end of the piston, referred to herein as the piston front surface, may form a movable wall, e.g., a proximal wall, of a compression chamber of the compression unit. In other examples, the distal end of the piston may form a movable section of a wall of the compression chamber. The compression chamber also is open, e.g., at a distal wall or elsewhere, to the transfer line that pneumatically links the compressor unit to the expander unit. The motion of the piston may cause changes in the volume and pressure of the gaseous working agent in the compression chamber, which may be transmitted to the expander unit via the transfer line. The piston and compression chamber are located in an interior space or bore of the linear electromagnetic driving mechanism.

The linear electromagnetic driving mechanism includes a stator assembly and a coaxial movable assembly that is movable back and forth parallel to the longitudinal axis. The stator assembly includes a driving coil, back iron, and an arrangement of static permanent magnets. The movable assembly includes a movable arrangement of permanent magnets separated by ferromagnetic spacers. The movable assembly is located radially exterior to the stator assembly. The axial motion of the movable assembly may be driven by the magnetic field that is created by alternating current flowing through the driving coil of the stator assembly. The movable assembly is directly connected to the piston. Thus, the current through the driving coil may drive the piston back and forth along the longitudinal axis within a central coaxial bore of the stator assembly. The driving coil is wound about the central bore and the longitudinal axis.

The effect of a built-in magnetic spring is formed by repulsion forces acting between two axially exterior (e.g., located on opposite sides of the movable assembly in the direction of the longitudinal axis) static permanent magnets (or arrangements of magnets) and the movable arrangement of permanent magnets that is coaxial with the exterior static arrangement. The movable arrangement is configured to move axially back and forth between the two exterior magnet arrangements. Both the exterior static arrangement and the movable arrangement are arranged azimuthally symmetrically about the longitudinal axis. For example, each magnet arrangement may include an axially magnetized ring or an azimuthally distributed (e.g., azimuthally symmetric) arrangement of separate axially magnetized permanent magnets.

In one example, the two exterior magnets of the exterior static arrangement are magnetically polarized opposite to one another and parallel to the longitudinal axis. The movable arrangement includes two coaxial permanent magnets separated by a ferromagnetic spacer. Each of the permanent magnets of the movable arrangement is magnetically polarized in the opposite direction to the exterior magnet arrangement that is nearest to that movable permanent magnet. Thus, each magnet of the movable arrangement is repelled by the magnets of the nearest exterior magnet arrangement. Other arrangements of magnets in the movable and exterior arrangements may be used.

When no current flows through the driving coil of the stator of electromagnetic driving mechanism the magnetic spring may maintain the movable arrangement at a stable equilibrium middle position where the repulsive and attractive forces exerted between the magnets of the movable arrangement and the magnets of the exterior arrangement (as well as attractive forces between the movable arrangement and a ferromagnetic toroidal back iron) are equal and opposite.

The driving coil of the stator is enclosed in a toroidal back iron except for a radially outward-facing band forming an outward-facing axial cylindrical air gap. The toroidal back iron may have a rectangular, circular, or otherwise shaped cross section. The back iron may thus shield the central bore of the driving coil, corresponding to the hole of the toroidal back iron, from the magnetic field that is generated by electrical current flowing through the driving coil. Therefore, moving components that include ferromagnetic materials, e.g., a piston liner and a cylinder liner made of hard and wear resistant tool steel or another ferromagnetic material, may operate within the central bore with minimal or no interference from electromagnetic fields that are generated by the driving coil.

The driving coil and back iron may be further completely encapsulated within a nonmagnetic casing (e.g., polyurethane, or another material) that isolates the driving coil (and associated electrical leads) from the gaseous working agent. The casing may thus prevent material that are outgassed from the driving coil and other electrical components from contaminating the gaseous working agent.

The magnetic field that is generated by electrical current flowing through the driving coil (e.g., as visualized by lines of magnetic field flux) is confined to the toroidal back iron. Therefore, the lips of the outward facing axial air gap in the toroidal back iron, where the magnetic field emerges from the toroidal back iron, function as magnetic poles of the hack iron. The polarity of the magnetic poles, as well as the strength of the magnetic field, is determined by the direction and magnitude of electrical current that flows through the driving coil.

When the amplitude of alternating electrical current in the driving coil is nonzero, the resulting electromagnetic field may cyclically axially displace the magnets of the movable arrangement so as to move back and forth about its stable equilibrium position. Since the movable arrangement is mechanically coupled to the piston, the alternating current that flows through the driving coil may cyclically move the piston back and forth. Thus, the piston may cyclically change the volume of the compression chamber, and thus the pressure of the gaseous working agent.

A piston assembly of the compression unit may include mechanical structure to which the movable arrangement of magnets of the magnetic spring assembly and the piston are both attached.

For example, the piston assembly may include mechanical structure in the form of a cylindrical cuplike structure. In this example, the movable arrangement may be mounted to, incorporated into, or otherwise attached to a cylindrical wall of the cuplike structure. The piston may be formed by the distal end of a columnar piston base lined with a piston liner that extends axially along the center of the cuplike structure. For example, a proximal end of the column may be attached to a floor of the cuplike structure.

The piston base may be located within the central bore of the of the stator assembly. The bore may be lined with a ferromagnetic cylinder liner made of a hard and wear resistant material like tool steel. Similarly, the wall of the piston base may be lined with a similar ferromagnetic piston liner. The width of the gap between the outer diameter of the piston liner and the inner diameter of the cylinder liner may be made sufficiently small so as to form a close clearance dynamic seals, thus impeding leakage of the gaseous working agent from the compression chamber at the distal end of the piston column to regions of the compression unit at the proximal end of the piston column (compressor back space).

A linear compressor unit, in accordance with embodiments of the present invention, that includes a linear electromagnetic actuator in which the stator generates a magnetic field that operates on a movable magnet component of a piston assembly that is radially exterior to the stator, may be advantageous over other types of compressor units.

For example, a prior art magnetic actuator in which the stator generates a magnetic field in an interior bore that acts on a radially magnetized movable ring within the bore would typically require a mechanical spring to axially center the movable ring. Such a mechanical spring could be subject to mechanical fatigue. Also, such an axially magnetized ring would typically be constructed of a plurality of linearly magnetized segments, which could contribute to the complexity and expense of its manufacture.

In another prior art example, the magnetic field that is generated by the stator within an interior bore acts on axially magnetized and movable components of a piston assembly that is located within the interior bore, Typically, the magnetic field that leaks into the interior bore would preclude, or render disadvantageous, the use of ferromagnetic materials (such as tool steel) to form the piston and cylinder liners. For example, the resulting magnetic attraction and consequent bonding between the piston and cylinder liners within the electromagnetic field could increase lateral forces, friction, and wear, and thus reduce actuator efficiency. Increasing the size of the radial gap between the movable components and the stator in order to reduce the influence of the electromagnetic fields could increase the size of the compression unit, thus affecting its use in constrained spaces. The nonmagnetic materials that could be used to substitute for ferromagnetic materials (e.g., hard ceramics such as silicon carbide, titanium carbide, and similar materials) typically have low resistance to wear and high brittleness, and may increase the expense of the actuator.

FIG. 1 schematically illustrates a split Stirling cryogenic refrigeration device with a compressor unit with a linear actuator with an interior stator, in accordance with an embodiment of the present invention.

Split Stirling cryogenic refrigeration device 10 includes compressor unit 12 and expander unit 14. A gaseous working agent (typically an inert gas such as helium or nitrogen) may be cyclically compressed and decompressed within a compression chamber 18 (FIG. 2) of compressor unit 12 by an electromagnetically driven piston assembly 28. The gaseous working agent in compressor unit 12 is in direct pneumatic communication with expander base **14*h* of expander unit 14 via flexible transfer line 16. Cold finger 14*a* of expander unit 14, e.g., a distal capped end of cold finger 14*a***, may be placed in thermal contact with an object that is to be cooled.

Figure 2:
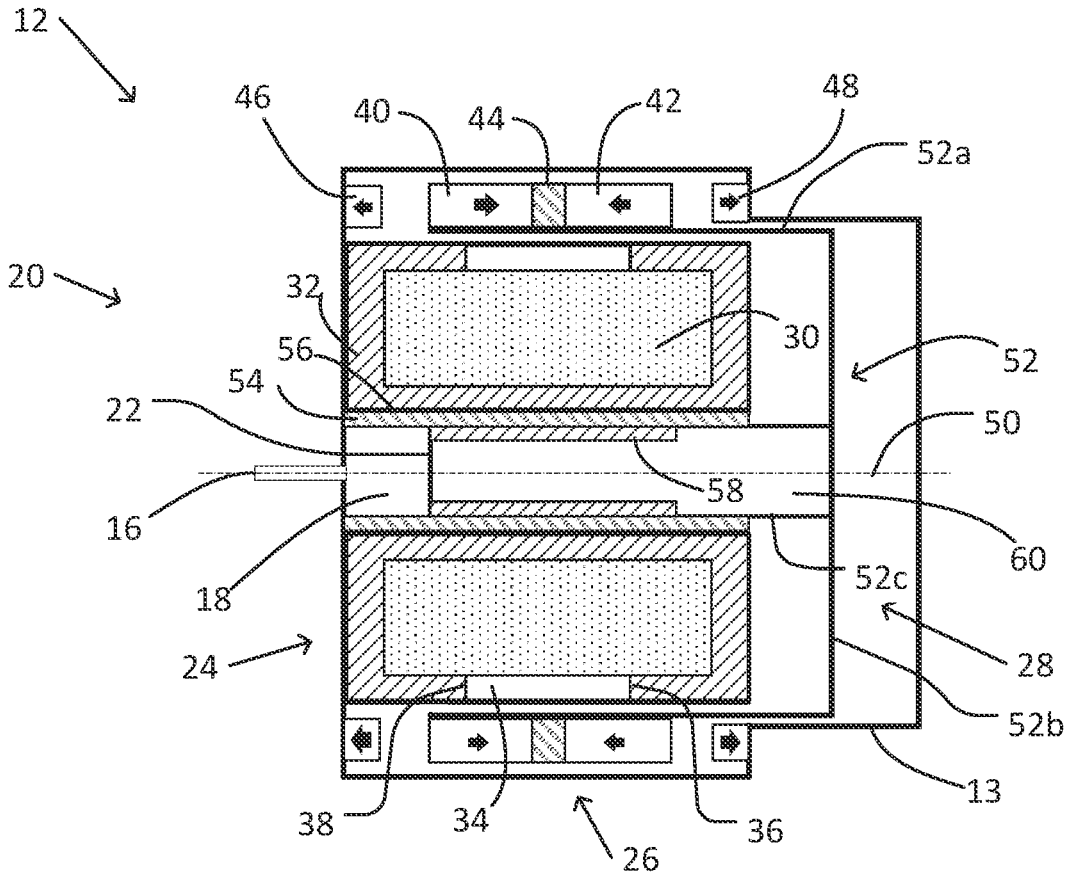
FIG. 2 is a schematic cross section of the compressor unit of the refrigeration device shown in FIG. 1.
Figure 3:
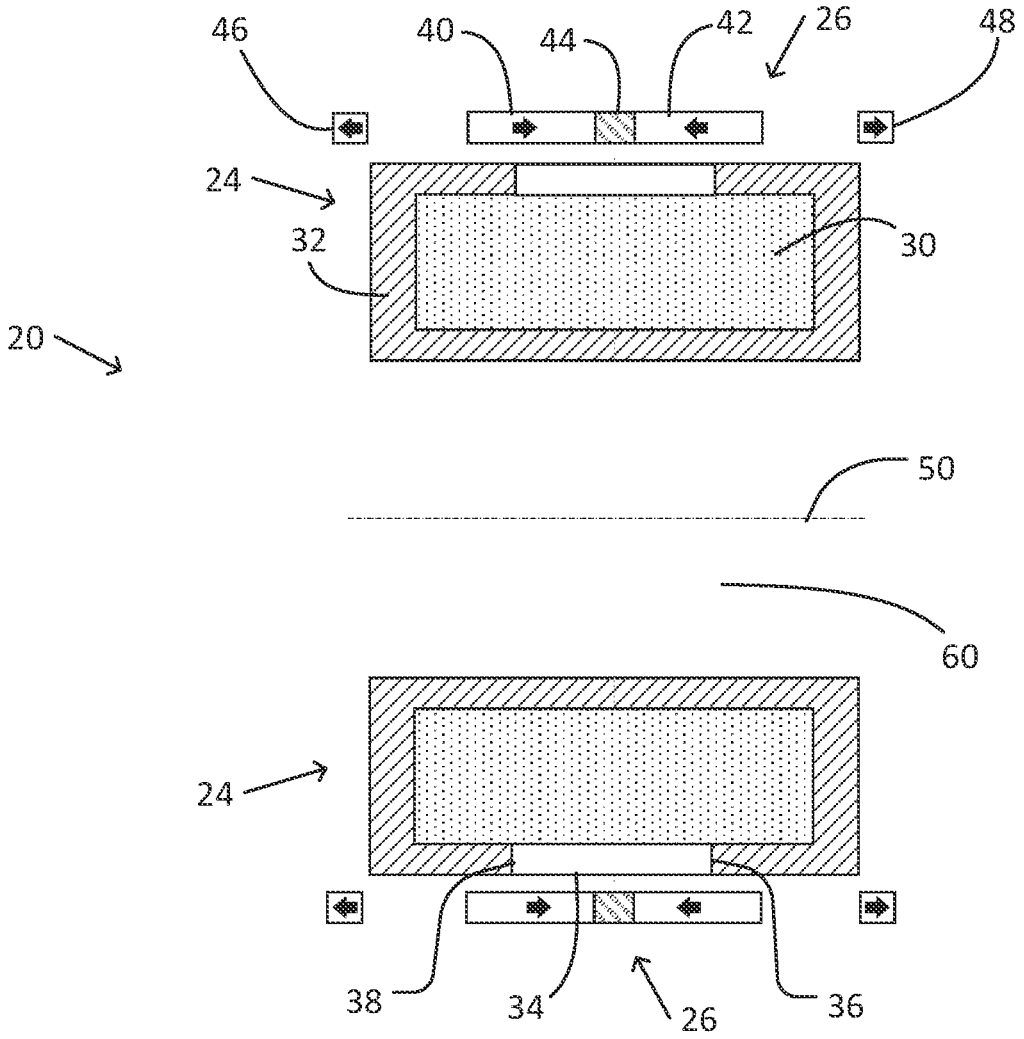
FIG. 3 is a schematic cross section of an electromagnetic actuator of the compressor unit shown in FIG. 2.

FIG. 2 is a schematic cross section the compressor unit of the refrigeration device shown in FIG. 3 is a schematic cross section of an electromagnetic actuator of the linear compressor unit shown in FIG. 2.

In the example shown, compressor unit 12 is considered to be azimuthally or rotationally symmetric about longitudinal axis 50. In other examples, other symmetries may be applied (e.g., rotational symmetry at a finite number of azimuthal orientations, e.g., separated by fixed angles of rotation).

Compressor unit 12 is enclosed within compressor housing 13. Typically, compressor housing 13 has a generally cylindrical shape. Compressor housing 13 is configured to confine a pressurized gaseous working agent, such as helium, nitrogen, or another inert gas, within compressor unit 12 and isolate the gaseous working agent from the surrounding atmosphere. Typically, compressor housing 13 is constructed of a nonmagnetic metal with high electrical resistance, such as titanium or stainless steel.

Linear electromagnetic actuator 20 is configured to move piston assembly 28 axially, e.g., parallel to longitudinal axis 50, back and forth within compressor housing 13. The axial motion of piston assembly 28 moves piston front surface 22 into and out of compression chamber 18. Compression chamber 18 is bound proximally by piston front surface 22, laterally by cylinder liner 54, and distally by a portion of compressor housing 13. The portion of compressor housing 13 that forms the distal end of compression chamber 18 includes an opening to flexible transfer line 16. Thus, the gaseous working agent that fills compression chamber 18 is in pneumatic communication via configurable and flexible transfer line 16 with the gaseous working agent within expander unit 14. Movement of piston front surface 22 effects changes in pressure and volume of the gaseous working agent in compression chamber 18, and thus may affect the gaseous working agent within expander unit 14.

Linear electromagnetic actuator 20 includes stator assembly 24, which is fixed relative to compressor housing 13, and movable assembly 26, which is fixed relative to piston assembly 28. Driving coil 30 is wound about longitudinal axis 50 (e.g., about a central bore that accommodates compression chamber 18 and piston base 60). Alternating electrical current that flows through driving coil 30 of stator assembly 24 may generate an electromagnetic field that exerts an axial electromagnetic force on movable assembly 26. The axial electromagnetic force may thus drive movable assembly 26 to move back and forth axially along longitudinal axis 50.

Driving coil 30 is enclosed in toroidal back iron 32 except within cylindrical axial air gap 34. Toroidal back iron 32 and driving coil 30 surround cylindrical piston base 60, which is coaxial with longitudinal axis 50. Typically, a central bore of toroidal back iron 32 is lined with cylinder liner 54. Typically, cylinder liner 54 is constructed of a hard and wear resistant material (like M42 tool steel or a similar material). Typically, the piston base 60 is lined with, e.g., surrounded by and attached to, piston liner 58. Typically, piston liner 58 is constructed of the same hard and wear resistant material as is cylinder liner 54, or a similar material In the example shown, driving coil 30 and toroidal back iron 32 have rectangular cross sections. A rectangular cross section may enable or facilitate efficient electromagnetic coupling between stator assembly 24 and movable assembly 26, as well as enable a compact design and placement of components.

Stator assembly 24, including driving coil 30 and toroidal back iron 32, are encapsulated within stator casing 56. Stator casing 56 may be constructed of a nonmagnetic material that is impermeable to the gaseous working agent. Thus, the gaseous working agent may be isolated from potential contamination by materials that are outgassed by driving coil 30 (e.g., by enamel coatings of wires or by release of residual air from hidden air pockets).

Piston assembly 28 includes piston structure 52 to which movable assembly 26 of electromagnetic actuator 20 is mounted and which includes piston surface 22. In the example shown, piston structure 52 is in the form of a cylindrical cup with a raised columnar piston base 52*c* extending upward from the center of the floor of the cup. Movable assembly 26 is mounted to cylindrical wall 52*a* of piston structure 52, corresponding to the sides of the cup. Piston base 52*c* extends distally along longitudinal axis 50 from connecting surface 52*b*, corresponding to the floor of the cup. Piston structure 52 may be designed to be sufficiently rigid so as not to bend or buckle during operation of compressor unit 12 to a degree that interferes with operation of compressor unit 12.

In the example shown, connecting surface 52*b* may be a contiguous surface. In other examples, connecting surface 52*b* may include spoke-like or other structure that connects cylindrical wall 52*a* to piston column 52*c*, Similarly, the other portions of piston structure 52, such as cylindrical wall 52*a*, may be contiguous surfaces or be in the form of a framework that includes openings.

Piston base 52*c* may be in the form of solid cylinder. For example, piston base 52*c* may be constructed of a durable material having high electrical resistance (such as titanium or a similar material), A distal surface of piston base 52*c* forms piston front surface 22. An outer surface of piston column 52*c* may be lined with piston liner 58. A gap between the outer surface of piston liner 58 (or another outer surface of piston column 52*c*) and the inner surface of bore liner 54 is sufficiently small so as to form close-clearance dynamic seals. The close-clearance seal may to prevent or impede leakage of the gaseous working agent from compression chamber 18 into other regions within piston structure 52 or compressor housing 13.

When alternating electrical current flows through driving coil 30, the resulting electromagnetic field may be channeled by toroidal back iron 32. Thus, back iron faces 36 and 38, which form annular lips hounding cylindrical axial air gap 34, may function as poles of an electromagnet from which an exterior magnetic field extends in to the space that radially surrounds cylindrical axial air gap 34. The magnetic polarity and force of each of hack iron faces 36 and 38 reverses and changes in magnitude in response to changes in the direction and magnitude of the electrical current that flows through driving coil 30.

The exterior magnetic field may exert a net axial force of movable assembly 26 of electromagnetic actuator 20. The axial force may vary in direction and magnitude with the varying of the alternating electrical current that flows through driving coil 30. The axial force may thus cause piston structure 52 to move back and forth coaxially within, and together with movable assembly 26 of, electromagnetic actuator 20. The axial motion of piston structure 52, and thus of piston front surface 22, may periodically compress and decompress the gaseous working agent in compression chamber 18.

In the example shown, movable assembly 26 of electromagnetic actuator 20 includes coaxial permanently magnetized movable magnetic rings 40 and 42. Both of movable magnetic rings 40 and 42 are magnetically polarized parallel to longitudinal axis 50, but in opposite directions. Movable assembly 26 includes ferromagnetic spacer ring 44 that is coaxial with movable magnetic rings 40 and 42 and axially separates between movable magnetic ring 40 and movable magnetic ring 42. For example, spacer ring 44 may be constructed of a ferromagnetic material to which either the north poles or the south poles of both movable magnetic rings 40 and 42 magnetically adhere. In the example shown, movable magnetic rings 40 and 42 are of substantially equal dimensions (e.g., some or all of inner and outer diameters and length) and are arranged at different axial positions on movable assembly 26.

Stationary magnetic rings 46 and 48 are fixed relative to compressor housing 13 and are coaxial with, and located axially exterior to, movable assembly 26. Each of stationary magnetic rings 46 and 48 is magnetically polarized parallel to longitudinal axis 50. Each of stationary magnetic rings 46 and 48 is magnetically polarized opposite to the other and to the nearest of movable magnetic rings 40 and 42. In the example shown, stationary magnetic ring 46 is magnetically polarized in the direction opposite to the magnetic polarization of movable magnetic ring 40. Similarly, stationary magnetic ring 48 is magnetically polarized in the direction opposite to the magnetic polarization of movable magnetic ring 42.

Thus, stationary magnetic rings 46 and 48 each repels the nearest magnet (movable magnetic ring 40 and 42, respectively) of movable assembly 26. Similarly, each of movable magnetic rings 40 and 42 is attracted to toroidal back iron 32, e.g., to back iron faces 38 and 36, respectively. Thus, in the absence of an exterior magnetic field that is generated by driving coil 30, the repulsion between stationary magnetic rings 46 and 48 and movable magnetic rings 40 and 42, respectively, as well as the attraction between movable magnetic rings 40 and 42 and toroidal back iron 32, may maintain movable assembly 26, and thus piston structure 52 and piston surface 22, at an equilibrium position. When current flowing through driving coil 30 generates a periodically varying exterior magnetic field, the field may act on movable assembly 26 to periodically displace move movable assembly 26, and thus piston structure 52 and piston surface 22, from its equilibrium position. As a result, movable assembly 26 and piston surface 22 are driven back and forth parallel to longitudinal axis 50.

Other arrangements may be used. For example, instead of the permanent magnets of movable assembly 26 being ring magnets, each ring magnet may be replaced by another arrangement of magnets (e.g., bar magnets that are oriented and magnetized parallel to longitudinal axis 50), e.g., azimuthally distributed about longitudinal axis 50.

Other variants in shapes and arrangements of magnets, and mechanical connections between movable assembly 26 and piston surface 22 are possible.

Different embodiments are disclosed herein. Features of certain embodiments may be combined with features of other embodiments thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A compressor unit of a split Stirling cryogenic refrigeration device, the compressor unit comprising:

a compression chamber that is connectable via a transfer lure to an expander unit of the refrigeration device;

a piston that is configured to be moved back and forth along a longitudinal axis to alternately compress and decompress a gaseous working agent in the compression chamber; and a linear electromagnetic actuator that is configured to drive the piston, the actuator comprising:

a stator assembly that includes a driving coil that is wound about the longitudinal axis and that is enclosed within a toroidal back iron except, for a coaxial cylindrical gap in a radially outward facing surface of the toroidal back iron; and a movable assembly that is connected to the piston, the movable assembly comprising two movable permanent magnets separated by a ferromagnetic spacer that are located radially exteriorly to the stator assembly, the two movable permanent magnets being magnetically polarized parallel to the longitudinal axis and oppositely to one another such that an alternating electrical current that flows through the driving coil causes the movable assembly to move back and forth parallel to the longitudinal axis so as to periodically drive the piston into and out of the compression chamber.

2. The compressor unit of claim 1, wherein the movable permanent magnets comprise magnet rings that are coaxial with the stator assembly.

3. The compressor unit of claim 1, further comprising two stationary magnetic rings that are coaxial with and axially exterior to the two movable permanent magnets, the two stationary magnetic rings magnetized in opposite directions parallel to the longitudinal axis such that each stationary magnetic ring is magnetized opposite the nearer of the two movable permanent magnets.

4. The compressor unit of claim 1, wherein a front surface of the piston forms a proximal wall of the compression chamber.

5. The compressor unit of claim 1, wherein a columnar base of the piston is lined with a ferromagnetic material.

6. The compressor unit of claim 1, wherein the piston is configured to move axially within a bore of the stator assembly.

7. The compressor unit of claim 6, wherein the bore is lined with a ferromagnetic material.

8. The compressor unit of claim 1, wherein the movable assembly is mounted on a cylindrical wall of a cuplike structure that connects the movable assembly to the piston.

9. The compressor unit of claim 8, wherein a front surface of the piston is located at a distal end of a columnar base that extends from a floor of the cuplike structure.

10. The device of claim 1, wherein the movable assembly is mounted on a cylindrical wall of a cuplike structure that connects the movable assembly to the piston.

11. The device of claim 10, wherein a front surface of the piston is located at a distal end of a columnar base that extends from a floor of the cuplike structure.

* * * * *